US011198541B2

(12) United States Patent
Hochberg et al.

(10) Patent No.: US 11,198,541 B2
(45) **Date of Patent: *Dec. 14, 2021**

(54) ADAPTIVE PACKAGE

(71) Applicant: The Procter & Gamble Company, Cincinnati, OH (US)

(72) Inventors: Scott David Hochberg, Cincinnati, OH (US); Edward Daniel Theiss, III, Union Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/535,119

(22) Filed: Aug. 8, 2019

(65) Prior Publication Data

US 2020/0055636 A1 Feb. 20, 2020

Related U.S. Application Data

(60) Provisional application No. 62/718,404, filed on Aug. 14, 2018.

(51) Int. Cl.

| | |
|---|---|
| ***B65D 33/24*** | (2006.01) |
| ***B65D 33/25*** | (2006.01) |
| ***B65D 75/58*** | (2006.01) |

(52) U.S. Cl.

CPC ..... *B65D 33/24* (2013.01); *B65D 33/2508* (2013.01); *B65D 75/5805* (2013.01); *B65D 2313/04* (2013.01)

(58) Field of Classification Search

CPC .. B65D 2313/04; B65D 21/08; B65D 33/007; B65D 33/16; B65D 33/1616; B32B 2307/208

See application file for complete search history.

(56) References Cited

U.S. PATENT DOCUMENTS

| | | | |
|---|---|---|---|
| 3,968,898 | A | 7/1976 | Beer |
| 5,027,966 | A | 7/1991 | Yadock |

(Continued)

FOREIGN PATENT DOCUMENTS

| | | | |
|---|---|---|---|
| CN | 2693663 | Y | 4/2005 |
| CN | 105644924 | A | 6/2016 |

(Continued)

OTHER PUBLICATIONS

International Search Report and Written Opinion dated Nov. 19, 2019, PCT/US2019/045594, 11 pgs.

(Continued)

*Primary Examiner* — Shawn M Braden

(74) *Attorney, Agent, or Firm* — Sarah M DeCristofaro; Steven Robert Chuey

(57) ABSTRACT

A package with magnetic closure portions. The package can include a first flexible polymeric sidewall and a second flexible polymeric sidewall. The first and second flexible polymeric sidewalls can be joined by opposing first and second sides and a bottom portion and together defining an access opening. A first magnetic region can be disposed on the first sidewall. A second magnetic region can be disposed on the first sidewall. A third magnetic region can be disposed on the second sidewall. A fourth magnetic region can be disposed on the second sidewall. The first and third magnetic regions can be magnetically engageable with a magnetic force to urge at least a portion of the first and second sidewalls into contacting relationship, and the second and fourth magnetic regions can be magnetically engageable with a magnetic force to urge at least a portion of the first and second sidewalls into contacting relationship.

20 Claims, 8 Drawing Sheets

(56) References Cited

U.S. PATENT DOCUMENTS 5,294,022 A 3/1994 Earle
5,424,703 A 6/1995 Blume, Jr.
5,428,332 A 6/1995 Srail
5,505,305 A 4/1996 Scholz
6,397,560 B1 6/2002 Weder
6,640,991 B1 11/2003 Amanat
6,749,551 B2 6/2004 Metzler
7,128,798 B2 10/2006 Boudouris
7,178,185 B1 2/2007 Nattler
8,556,876 B2 10/2013 Beckman
9,062,222 B2 6/2015 Nilsson
9,305,598 B2 4/2016 Rossiter
9,533,786 B1 1/2017 Feinstein
2002/0027138 A1 3/2002 Hyobu
2003/0142887 A1* 7/2003 Sleight ..... B65D 33/14 383/7
2003/0218525 A1 11/2003 Sugawara
2004/0001973 A1 1/2004 Gao
2004/0241394 A1 12/2004 Burrows
2005/0056655 A1* 3/2005 Gary ..... A47G 19/2261 220/737
2005/0230465 A1* 10/2005 Metzler ..... B65D 5/727 229/125.37
2005/0242097 A1 11/2005 Morin
2005/0285749 A1* 12/2005 Schmidt-Troschke ..... B65D 33/00 340/686.1
2006/0168767 A1* 8/2006 Huang ..... B65D 63/1027 24/16 PB
2006/0231562 A1* 10/2006 Carroll ..... B65D 81/3879 220/737
2006/0283750 A1 12/2006 Villars
2010/0308039 A1 12/2010 Miros
2011/0253571 A1* 10/2011 Rothbaum ..... H04M 1/15 206/320
2012/0018428 A1* 1/2012 Norman ..... B65D 33/16 220/6
2012/0073242 A1* 3/2012 Nilsson ..... B65D 5/4216 53/64
2012/0076995 A1* 3/2012 Nilsson ..... B32B 15/12 428/195.1
2012/0103506 A1* 5/2012 Love ..... H01F 1/16 156/244.11
2012/0216374 A1 8/2012 Manuello
2013/0032503 A1* 2/2013 Nobile ..... B65D 77/20 206/494
2013/0061431 A1 3/2013 Naftali
2014/0008425 A1 1/2014 Clark
2014/0034080 A1* 2/2014 Paquet ..... B65D 43/26 132/286
2014/0093299 A1 4/2014 Lambert
2015/0023223 A1 1/2015 Robbins
2015/0196955 A1 7/2015 Naftalin
2015/0305402 A1* 10/2015 Bourgoin ..... B05D 1/26 206/265
2016/0039575 A1 2/2016 Murray
2016/0095763 A1* 4/2016 Mazor ..... B65F 1/00 206/205
2016/0221722 A1* 8/2016 Burke ..... B65D 85/18
2017/0066559 A1* 3/2017 Kim ..... B65D 31/08
2017/0105556 A1 4/2017 Tarpey
2017/0159295 A1* 6/2017 Warner ..... B32B 25/16
2017/0275056 A1* 9/2017 Boudouris ..... B65D 33/24
2018/0042403 A1* 2/2018 Storace ..... A47B 87/0269
2018/0339806 A1 11/2018 Sugita
2019/0133281 A1 5/2019 Munie
2020/0055635 A1 2/2020 Hochberg
2020/0055659 A1 2/2020 Hochberg
2020/0058430 A1 2/2020 Hochberg

FOREIGN PATENT DOCUMENTS

CN 205998313 U 3/2017
DE 202009000499 U1 3/2009
EP 741555 B1 12/1997
EP 665737 12/1998
EP 1683736 B1 3/2010
EP 1507659 B1 2/2011
EP 3038938 B1 10/2018
EP 2935029 B1 2/2019
EP 3123489 B1 5/2019
FR 2680761 A1 3/1993
GB 1121773 A 7/1968
JP 2010046152 A 3/2010
JP 2010223107 A 10/2010
JP 2012101848 A 5/2012
JP 2015020779 A 2/2015
JP 2018038596 A 3/2018
WO WO2006135313 A1 12/2006
WO WO2014096427 A1 6/2014
WO WO2015132025 A1 9/2015
WO WO2016139170 A1 9/2016
WO WO2017002139 A1 1/2017
WO WO201721398 A1 2/2017
WO WO2017172542 A1 10/2017

OTHER PUBLICATIONS

International Search Report and Written Opinion dated Oct. 18, 2019, PCT/US2019/045595, 12 pgs.
International Search Report and Written Opinion dated Oct. 18, 2019, PCT/US2019/045596, 12 pgs.
International Search Report and Written Opinion dated Oct. 23, 2019, PCT/US2019/045597, 12 pgs.
All Office Actions; U.S. Appl. No. 16/535,122.
All Office Actions; U.S. Appl. No. 16/535,118.
All Office Actions; U.S. Appl. No. 16/535,117.

* cited by examiner

ADAPTIVE PACKAGE

FIELD OF THE INVENTION

Embodiments of the technology relate, in general, to packaging having magnetically engaging portions and varying volume, dimension, and shape states.

BACKGROUND OF THE INVENTION

Packaging for containing dispensable items finds use in a wide variety of consumer and business products. Often such packaging is intended to contain products that can be removed and consumed in partial quantities, leaving the package partially filled. Being able to effectively close a partially full package in a manner that represents the change in quantity can be challenging. In addition, commercially viable packaging dimensions should be designed simultaneously for efficient shipping and efficient consumer use. The shape of a package is often a compromise between solving a problem of efficient shipping to a retail outlet and efficient and convenient use by the consumer.

There remains an unmet need, therefore, for packaging that permits effective closure of a partially full package.

Additionally, there remains an unmet need for packaging that permits effective closure of a partially full package and that can adapt multiple shapes with sufficient stability to improve a consumer's use experience that can be manufactured in a commercially viable manner.

DETAILED DESCRIPTION OF THE INVENTION

Figure 1:
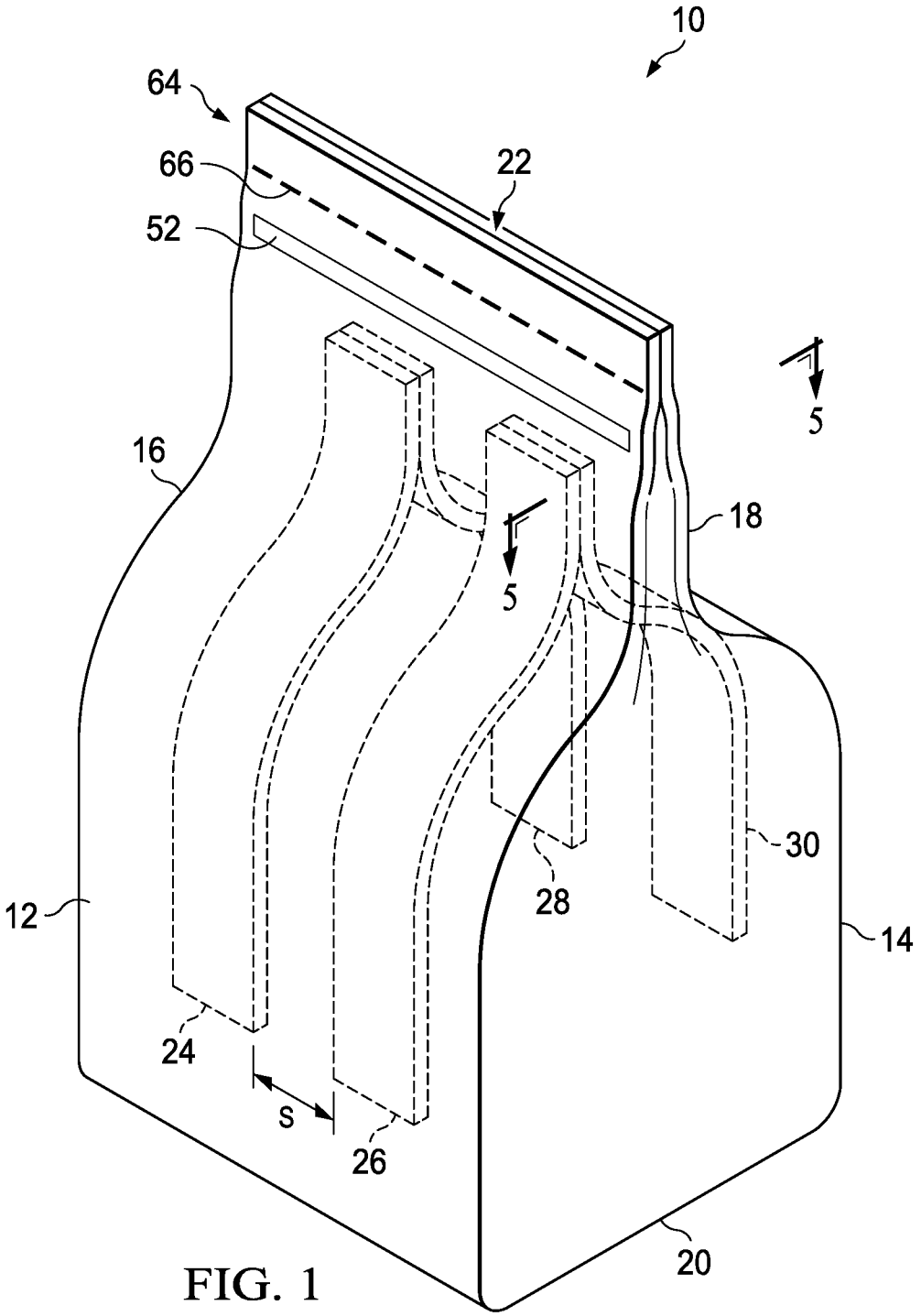
FIG. 1 is a perspective view of an embodiment of a package of the disclosure.

Certain embodiments are hereinafter described in detail in connection with the views and examples of FIGS. 1-8, wherein like numbers refer to like elements throughout the views.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific FIG. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

The present disclosure relates generally to packaging having an opening through which items can be removed or dispensed. The packaging can be flexible packaging, such as pouches, bags and boxes, which can be made of flexible materials such as polymer films, foil films, laminates, and the like. The term "flexible" is utilized herein to refer to materials that are capable of being flexed or bent especially repeatedly such that they are pliant and usable in response to externally applied forces. Accordingly, "flexible" is substantially opposite in meaning to terms such as "inflexible", "rigid", or "unyielding". Materials and structures that are flexible therefore may be altered in shape and structure to accommodate external forces and to conform to the shape of objects brought into contact with them without losing their integrity. Flexible films of the type commonly available can be formed from materials having consistent physical properties throughout the film structure, such as stretch, tensile and/or elongation properties. For any of the embodiments of flexible containers, disclosed herein, in various embodiments, any of the flexible materials can be configured to have an overall thickness 5-5000 micrometers (μm), or any integer value for micrometers from 5-5000, or within any range formed by any of these values, such as 10-5000 μm, 20-3000 μm, 30-1000 μm, 50-800 μm, or 100-500 μm, etc.

Materials suitable for packages of the present disclosure can include, for example and without limitation, polyethylene, polyester, polyethylene terephthalate, nylon, polypropylene, polyvinyl chloride, and the like. The package may be formed from a laminate construction of a plurality of layers comprising coatings or dissimilar films, such that the sidewalls are a composite construction. Examples of such coatings include, without limitation, dissimilar materials, polymer coatings, metalized coatings, ceramic coatings, and/or diamond coatings. Such coating materials and/or laminate construction may reduce permeability of the laminates so formed.

In some embodiments, the materials of side wall may be film laminates that include multiple layers of different types of materials to provide desired properties such as strength, flexibility, the ability to be joined, imperviousness to the flowable product contained in the assembled container and the ability to accept printing and/or labeling One example of a film laminate includes a tri-layer low-density polyethylene (LDPE)/Nylon/LDPE with a total thickness of 0.003 inches.

Other types of laminate structures may be suitable for certain embodiments. For example, laminates can be created from co-extrusion, or coat extrusion, of multiple layers or laminates produced from adhesive lamination of different layers. Furthermore, coated paper film materials may be used for some embodiments. Additionally, laminating non-woven or woven materials to film materials may be used in certain embodiments. Other examples of structures which may be used in certain embodiments include: 48ga polyethylene terephthalate (PET)/ink/adh/3.5 mil ethylene vinyl alcohol (EVOH)-Nylon film; 48ga PET/Ink/adh/48ga MET PET/adh/3 mil PE; 48ga PET/Ink/adh/.00035 foil/adh/3 mil PE; 48ga PET/Ink/adh/48ga SiOx PET/adh/3 mil PE; 3.5mil EVOH/PE film; 48ga PET/adh/3.5 mil EVOH film; and 48ga MET PET/adh/3mil PE.

The flexible packaging can contain and dispense solid items, or fluid contents, or other fluent items such as powders, and like items. In general, non-limiting embodiments of packaging are disclosed herein as flexible packaging. Flexible packaging can include, for example, polymeric sidewalls and can be in the form of formable bags or pouches.

In embodiments, the closing features disclosed herein can include magnetic regions under mutual magnetic attraction.

The magnetic regions of the flexible packaging can be magnets and can be disposed on two or more sidewalls of the flexible packaging in a manner in which they are mutually attracted to draw the sidewalls into at least partial contacting relationship. In embodiments, the magnetic regions can be the result of a magnetized material such as a magnetizable ink that has been deposited in a predetermined pattern on sidewalls of the flexible packaging, cured (if necessary), and magnetized. In an embodiment, the magnetizable material can be a magnetic ink magnetized by a process utilizing pairs of mating magnetic arrays in which the magnetic ink is deposited, such as by printing, onto a flexible web substrate and passed through the gap between the mating magnetic arrays. In an embodiment, the flexible web substrate can contact one of the magnetic arrays.

In an embodiment, an apparatus and method for magnetizing a magnetizable material into patterns of north and south poles on a flexible web substrate is referred to as a Hybrid Magnetization Process and is disclosed in co-owned, US Pat. Ser. No. 62/718,402 which was filed on the same day as the present disclosure in the name(s) of Scott David Hochberg, as, and which is hereby incorporated herein by reference.

In an embodiment, a magnetizable material can be deposited, such as by printing or extrusion, onto a synthetic or natural web substrate. Further, the magnetizable material and/or the web substrate having deposed thereon the magnetizable material can be generally planar and continuous on at least two parallel surfaces. In an embodiment, the magnetizable material comprises a magnetic ink available from ACTEGA North America, Delran, N.J., and can comprise a substrate, a primer and magnetic ink. A water-based adhesion assisting primer can be deposited and cured on a substrate, such as a polymer film. A magnetic ink can be deposited on top of the substrate and cured using a UV light source. The magnetic ink can comprise monomers, oligomers, photoinitiators and isotropic neodymium iron boron particles. Multiple layers of the magnetic ink can be used to increase the amount of magnetizable material on the substrate.

Referring to FIG. 1, there is shown an example of a package 10, which can be a flexible package 10 for dispensing items contained in the package. The flexible package 10 can have a first major sidewall 12 and a second major sidewall 14. The flexible packaging can have one or more minor sidewalls 18 that can be relatively smaller in size and shape than the major sidewalls and can join the major sidewalls 12, 14 together with a bottom portion 20 to form a package 10 in the form of a bag, which can be a flexible polymeric bag, having an opening 22, which is generally understood to be a top opening in use. Minor sidewalls 18 can be gusseted to facilitate package deformation, including folding (as described, for example, with respect to FIGS. 7 and 8 below). Each sidewall 12, 14 can have a perimeter 16. In an embodiment the major sidewalls 14, 16 can be joined together, such as by adhesive, welding, crimping, or the like to minor sidewalls 18 and the bottom portion 20, as illustrated in the example shown in FIG. 1. In an embodiment the major sidewalls 14, 16 can be joined together, such as by adhesive, welding, crimping, or the like to each other at the perimeter 16 to form a container, such as a pouch, having generally two sides and an interior compartment 50 and an opening 22. The interior compartment can be closed when opening 22 is closed, or can have fluid communication with the exterior portions when opening 22 is open. In general, any number of sidewalls can be utilized, but for simplicity, the invention is disclosed herein as having two sidewalls joined about their respective peripheries and forming an opening. Further, the term "sidewall" is not to be taken as suggesting any degree of flatness, shape, size, or thickness.

The flexible package 10 can have magnetic regions disposed in opposing relationship on at least the first and second major sidewalls 14 and 16. In general, at least one pair of opposing magnetic regions can be disposed in operatively magnetic attraction on the major sidewalls to effect variable volume or shape of the closed package, as disclosed more fully below.

In an embodiment, as shown in FIG. 1, two magnetic regions on each of two opposing major sidewalls can be utilized. Magnetic regions 24 and 26, for example, can be generally elongated in the direction from the top opening 22 to a bottom portion 20 and separated in spaced relationship by a distance S, as indicated in FIGS. 1-4, which show various example configurations for magnetic regions. In general, the number and spacing S of magnetic regions can be selected for sufficient closure properties depending on the strength of the magnetic force of the magnetic regions, the size of the package, the shape of the package, the stiffness of the package material, and any other physical properties that affect the ability of the package to have variable volume when closed as disclosed herein. In an embodiment, the entire face of each major sidewall 12, 14 can be a magnetic region. Further, package 10 can have disposed on one or both of major sidewalls 12, 14 a closure mechanism 52. Closure mechanism 52 can be any of known mechanisms for closure of packaging, including a zip track closure with a slider zip closure. Closure mechanism can also be a separate magnetic region of the type disclosed herein. Closure mechanism 52 can also comprise, or work in conjunction with, a frangible portion 64 that can serve to provide complete sealing of package 10 during shipping and storage, but which can be removed prior to use to open package 10. Frangible portion 64 can include a line of weakness 66, such as a perforated line, that can be torn off to open package 10.

Figure 2:
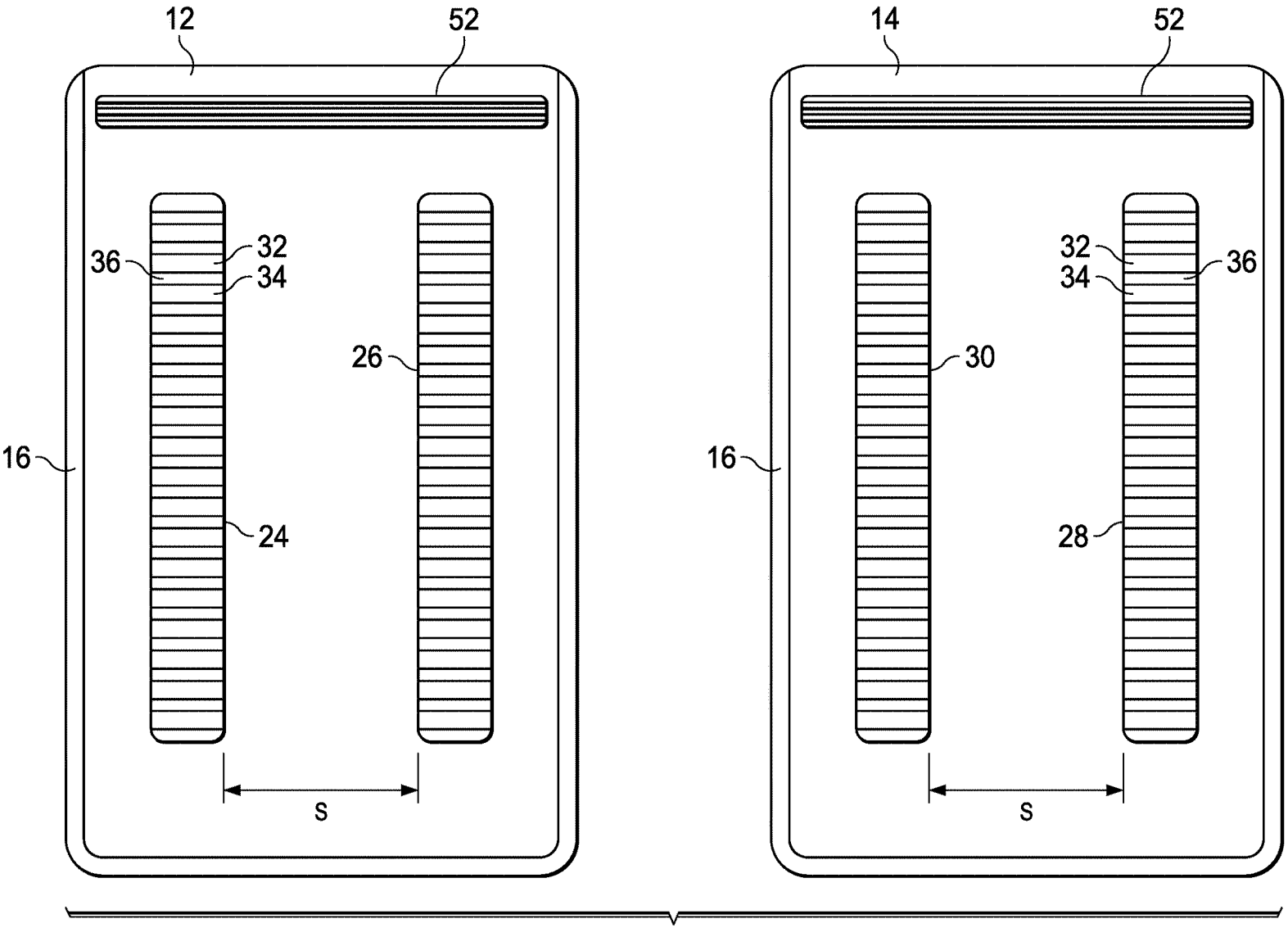
FIG. 2 is a side view of a portion of a package of the disclosure.
Figure 3:
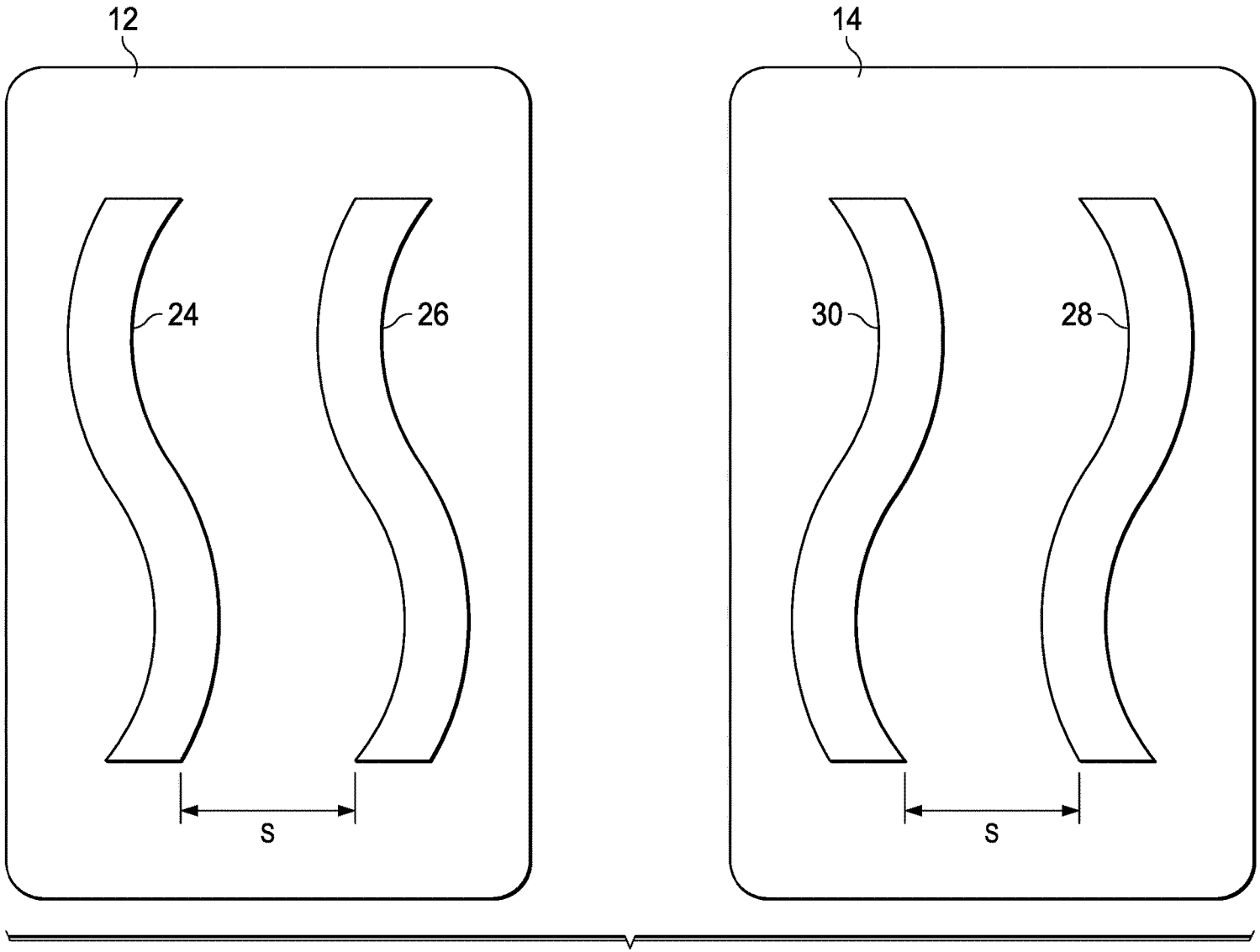
FIG. 3. is a side view of a portion of a package of the disclosure
Figure 4:
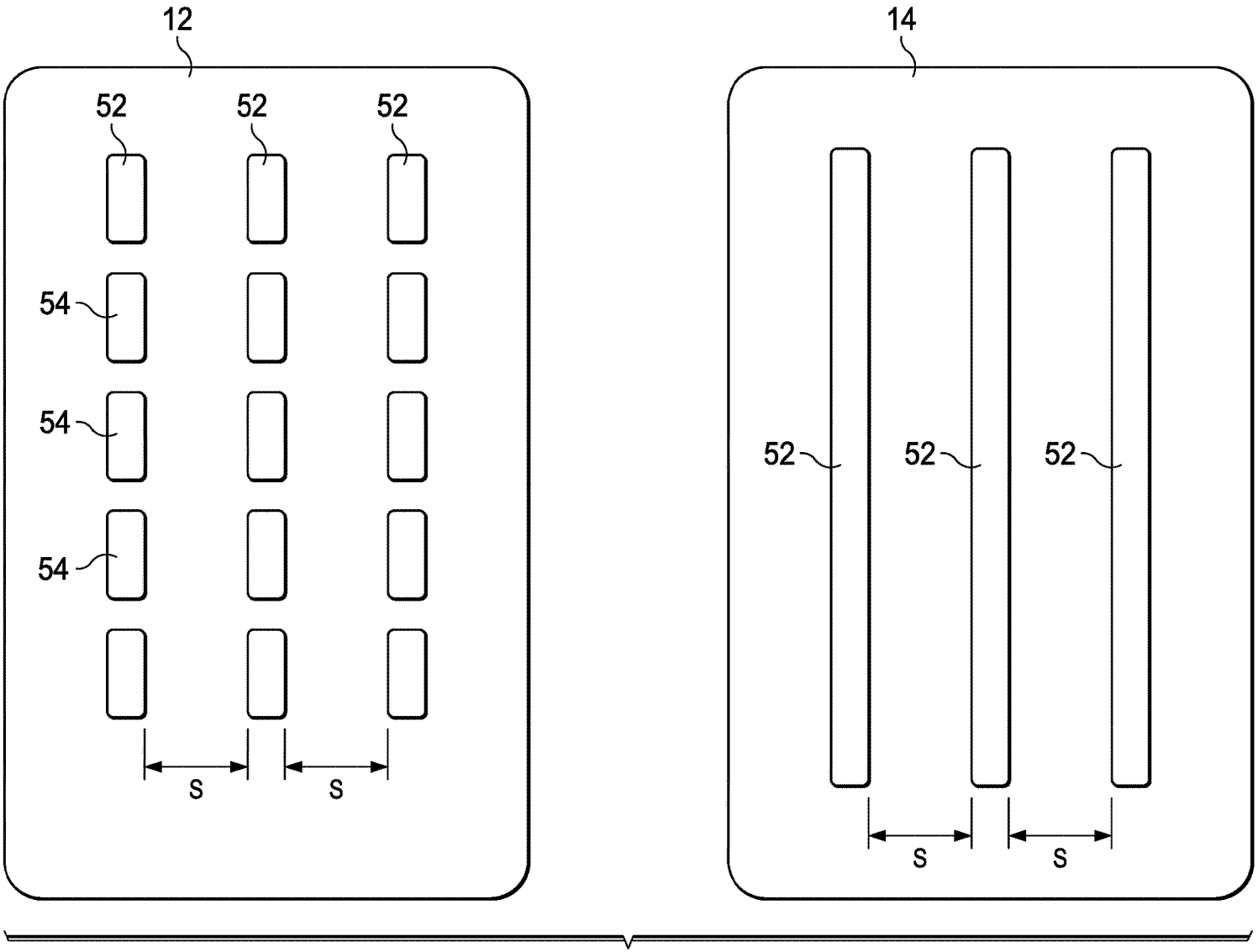
FIG. 4 is a side view of a portion of a package of the disclosure.

FIGS. 2-4 show various non-limiting examples of magnetic regions as can be practiced in accordance with the present disclosure. In each of FIGS. 2-4 first major sidewall 12 is shown on the left, and second major sidewall 14 is shown on the right. The illustrations of FIGS. 2-4 can be considered to be viewing the major sidewalls 12, 14 if package 10 as shown in FIG. 1 was opened up and the sidewalls separated and flattened. In each of FIGS. 2-4 the face of each sidewall 12, 14 closest to the viewer as depicted can be either an external face (i.e., on the outside of package 10), or an internal face (i.e., on the inside of package 10). As can be understood, therefore, magnetic regions can be disposed either on the outside of package 10 or the inside of package 10. Likewise, magnetic regions can be disposed in the interior of a laminate material used for package 10.

As shown in FIG. 2, first major sidewall 12 can have disposed thereon in a spaced relationship a first magnetic region 24 and second magnetic region 26. Likewise, second major sidewall 14 can have disposed thereon in a spaced relationship third magnetic region 28 and fourth magnetic region 30. Magnetic regions 24, 26 can be sized according to the size and shape of the package 10 and their respective forces of attraction. Magnetic regions can comprise magnetized magnetic ink that can be printed onto a region of the package and sized and shaped according to the requirements of the particular packaging task. Magnetic regions 24 can be flexible, and can be as flexible as the material of the sidewall 12, 14. Magnetic regions 24 can comprise magnetic ink deposited, such as by printing, in a relatively thin layer, such that the portions of sidewalls 12 and 14 comprising magnetic regions can be generally flexible, and can be flexibly magnetically attracted to one another.

In general, opposing magnetic regions, e.g., magnetic regions 26 and 30 of FIG. 1, can mirror one another in shape, size and position, and can be disposed opposite one another in the package 10. Portions of opposed magnetic regions can be in a partially separable magnetically contacting state, as shown in FIG. 1. In general, magnetic regions can, when in a magnetically contacting state effect closure and reduction in volume of the flexible package 10.

Magnetic regions can each comprise a pattern of alternating north pole bands 32 and south pole bands 34 of magnetized material, such as ink. The bands 32 and 34 can be separated by neutral zones 36. In general, the bands can be in a pattern of continuous stripes of alternating poles, with a predetermined pole density that can be the result of the manufacturing process to produce them. Bands can be produced in processes comprising passing a substrate comprising a magnetizable material through one or more pairs of magnetic arrays such as flux-pumping arrays, diametric arrays, or the aforementioned Hybrid Magnetization Process.

The bands or strips of magnetized poles can be oriented parallel to, perpendicular to, or at an angle with respect to the overall orientation of a magnetic region. In FIG. 2, for example, representative north pole bands 32 and south pole bands 34 and neutral zones 36 are depicted generally perpendicular to the overall orientation of a magnetic region. Likewise, the bands 32 and 34 need not be continuous in the form of stripes, but can be a band-like feature comprising discrete circular-shaped, oval-shaped, rectangular-shaped, and the like portions of magnetized material.

Another embodiment of magnetic regions is shown in FIG. 3. In addition to the description of FIG. 2, which can be applied to FIG. 3, the example shown in FIG. 3 shows that magnetic regions 24, 26, 28, and 30 need not have a substantially linear shape, but can be curvilinear. In an embodiment, opposing magnetic regions mirror one another, so that the size, shape and placement of magnetic regions 24 and 26, for example, can have the same size, shape and placement as magnetic regions 28 and 30.

Another embodiment of magnetic regions is shown in FIG. 4. In addition to the description of FIGS. 2 and 3, which can be applied to FIG. 4, the example shown in FIG. 4 shows that a plurality of magnetic regions 52, in this case three on each major sidewall 12 and 14, need not each be a continuous magnetized portion. As shown on major sidewall 12 in FIG. 4, each of a plurality of magnetized regions 52 can extend in a general band-like orientation (up and down in FIG. 4) and can be comprised of discrete magnetized units 54. In an embodiment, opposing magnetic regions need not exactly mirror one another, but it can be that the overall size, shape and placement of continuous magnetic regions 52, for example as shown on major sidewall 14, can have the same overall size, shape and placement as magnetic regions 52 made up of discrete magnetized units 54.

Figure 5:
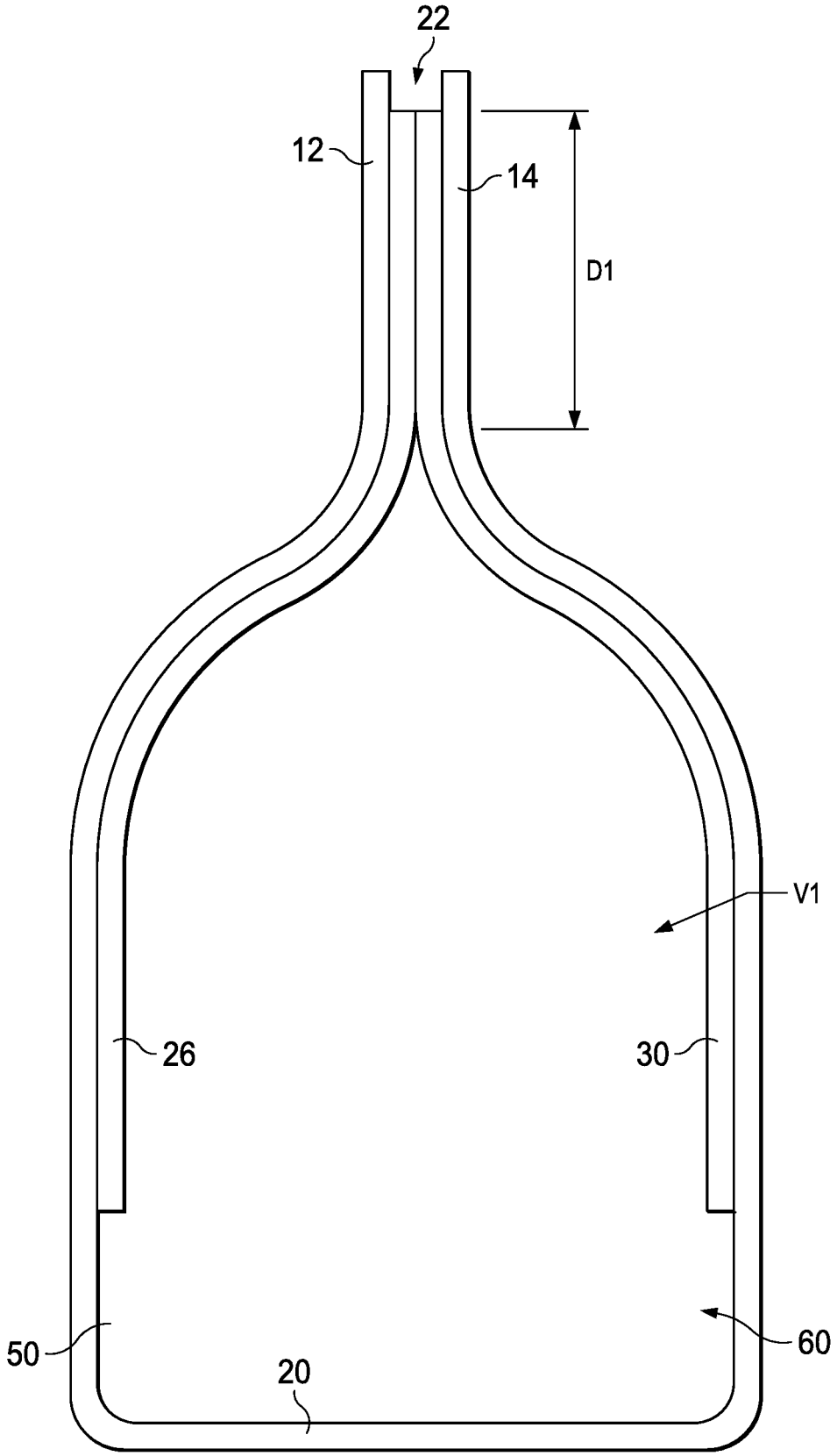
FIG. 5 is a cross-sectional view of Section 5-5 of FIG. 1.
Figure 6:
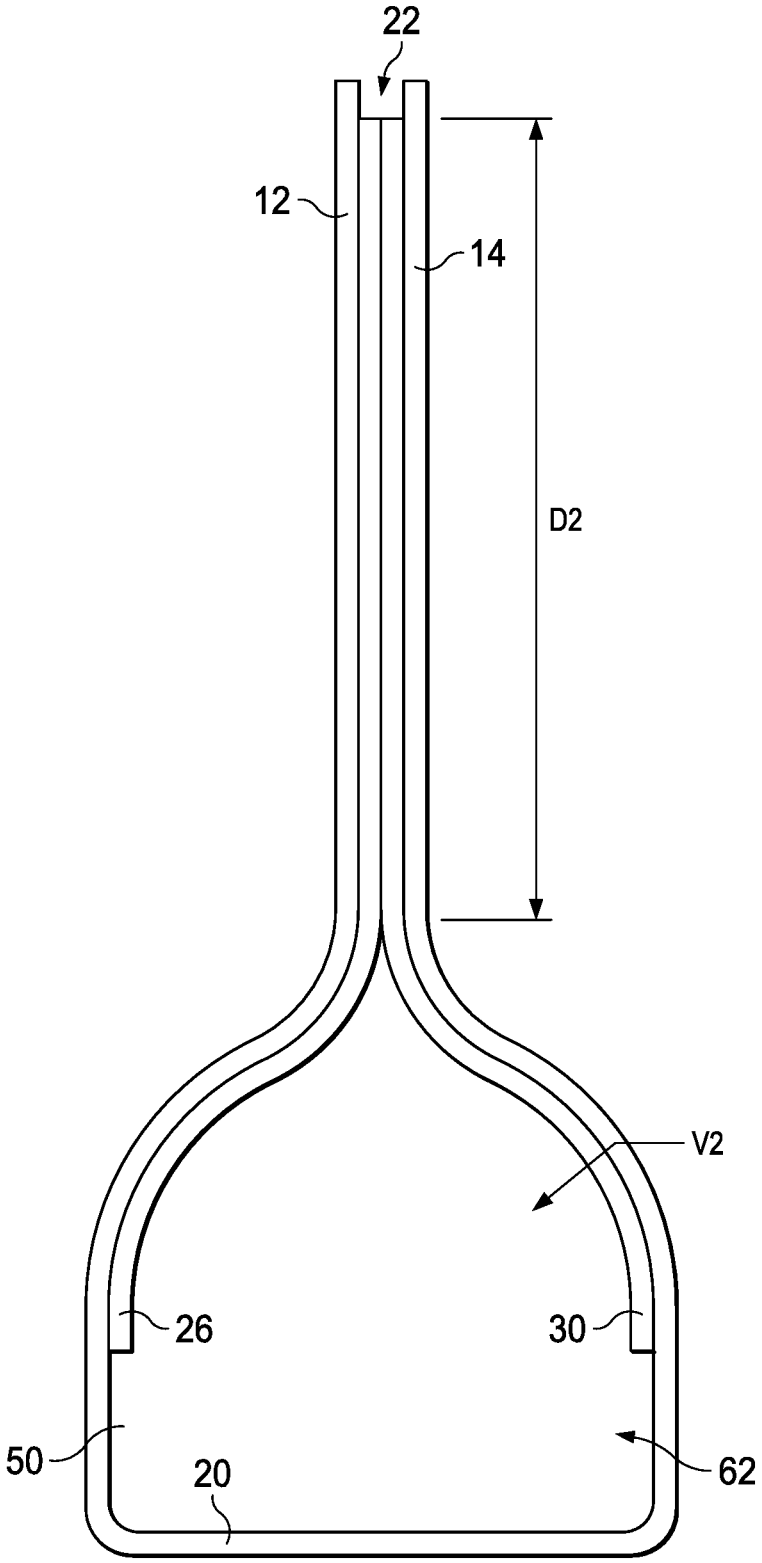
FIG. 6 is a cross-sectional view of Section 5-5 of FIG. 1.

FIGS. 5 and 6 are cross-sectional representations of Section 5-5 of FIG. 1. FIGS. 5 and 6 illustrate the operation of package 10 including magnetic regions to effect closing of the package 10 in varying states of separable magnetic engagement to render a package having varying enclosed volume states. As shown in FIG. 5, package 10 can be in a closed position such that magnetic regions 26 and 30 are partially magnetically engaged in a first position spanning an engaged distance D1. In the configuration shown in FIG. 5, package 10 can have a first enclosed volume V1, 60 determined by the amount of partial magnetic engagement of the magnetic regions.

As shown in FIG. 6, package 10 can be in a closed position such that magnetic regions 26 and 30 are more fully magnetically engaged (relative to the position shown in FIG. 5) in a second position spanning an engaged distance D2. In the configuration shown in FIG. 6, package 10 can have a second enclosed volume V2, 62 determined by the amount of partial magnetic engagement of the magnetic regions. The second enclosed volume V2, 62 is less than the first enclosed volume V1, 60.

Figure 7:
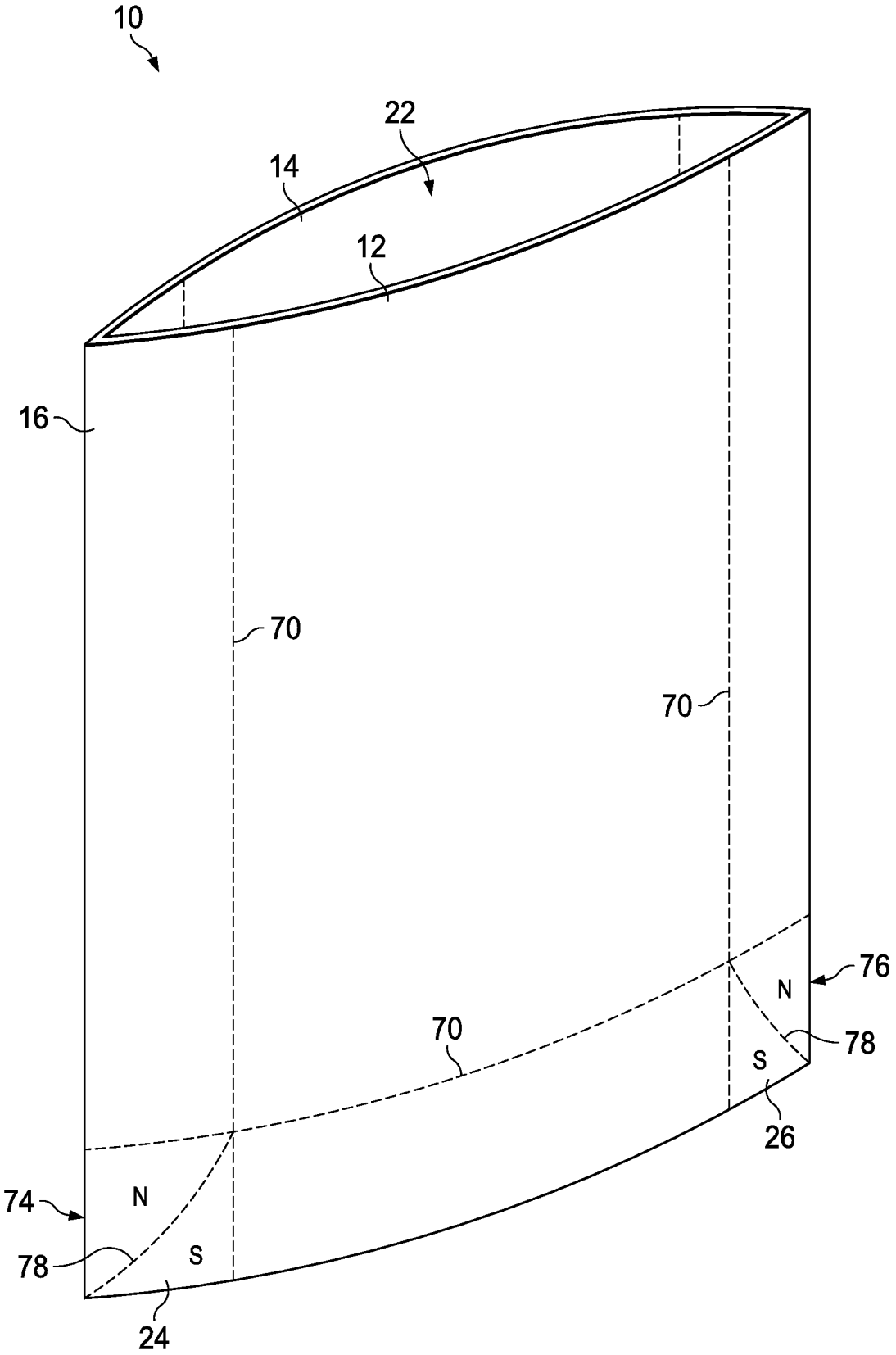
FIG. 7 is a perspective view of an embodiment of a package of the disclosure.
Figure 8:
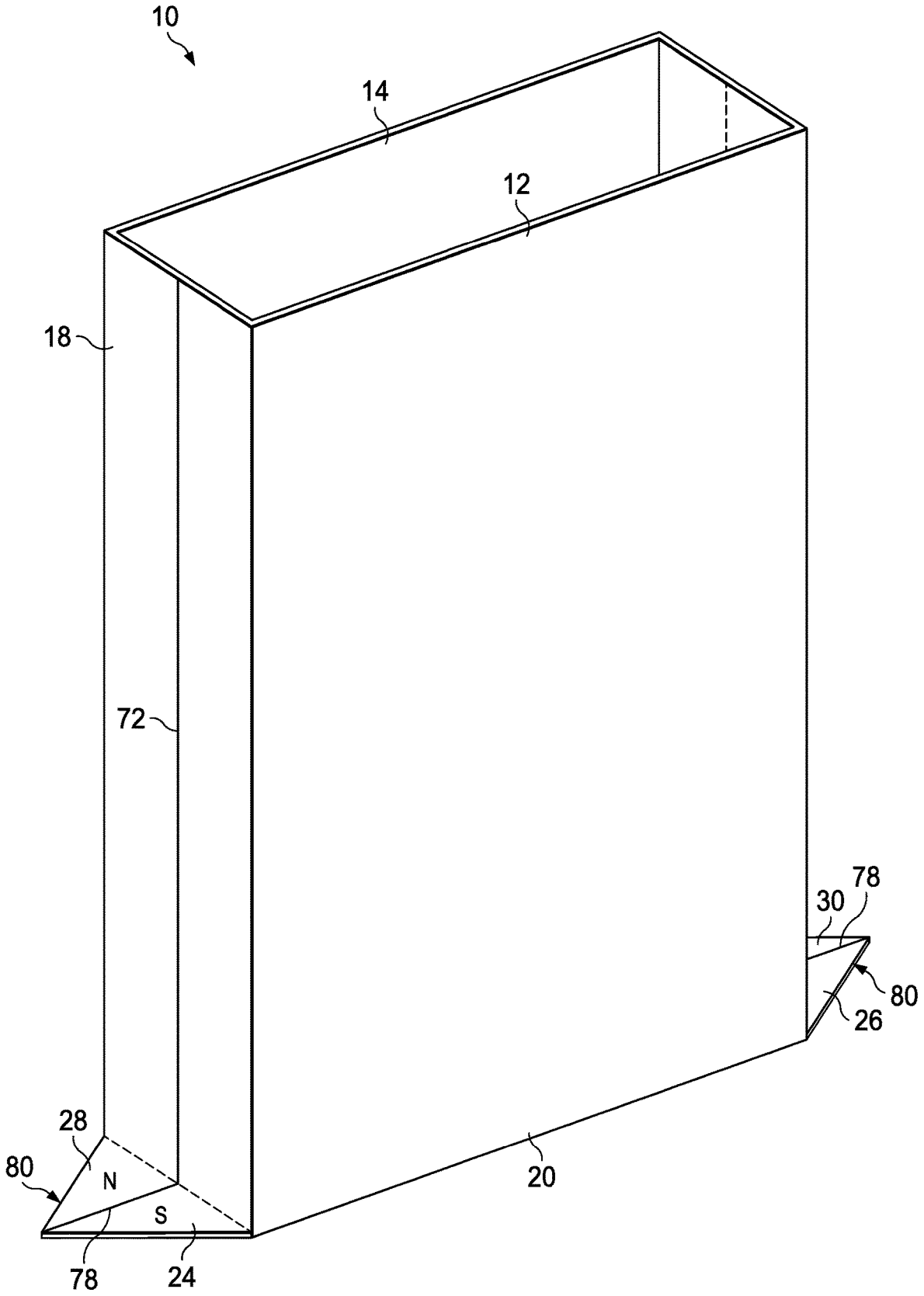
FIG. 8 is a perspective view of an embodiment of a package of the disclosure.

The flexible package 10 need not have any specific shape, and the shapes illustrated are non-limiting examples only. For example, in FIGS. 7 and 8 is shown another non-limiting example of a package 10 of the present disclosure. The package 10 shown in FIGS. 7 and 8 can have the beneficial advantage of being self-standing during use, including after opening. As shown, package 10 can have major sidewalls 12 and 14, as well as minor sidewalls 18. Package 10 can comprise sidewall fold lines 70, on sidewalls 12 and 14 which, when folded, can form corners that define minor sidewalls 18 and bottom portion 20, as shown in FIG. 8.

At the corners 74 and 76 between sidewall 12 and bottom portion 20 can be first and second magnetic regions 24 and 26. Likewise, at the corners 74 and 76 between sidewall 14 and bottom portion 20 can be third and fourth magnetic regions 28 and 30. Each of the magnetic regions can have north and south poles, including north pole bands 32 and south pole bands 36, as described above.

The package 10 can be in the configuration shown in FIG. 7, which can be a generally flat configuration with perimeter 16 being the outside perimeter and sidewalls 12 and 14 being in a generally flat, contacting configuration. The package 10 can be converted into a self-standing package by folding along fold lines 70 so as to "push" perimeter 16 in to form gusseted sidewalls 18 and gusseted bottom portion 20. Corners 74 and 76 can each be deformed, such as by folding along corner fold lines 78 running at a diagonal between fold lines 70 and corners 74 and 76, which can be achieved by "pinching" the corners together to the configuration shown in FIG. 8, in which opposing magnetic regions can be attracted and held in separable magnetic contact. That is, for example, on sidewall 12, a portion of corner 74 can be attracted to and in magnetic contact with another portion of corner 74, such that the folded corner tabs 80 shown in FIG. 8 facilitate a stable, self-standing package 10.

The magnetic force holding the self-standing package 10 of FIG. 8 can be based on a complimentary arrangement of magnets printed on the package side walls to provide the structural stability. Contents can advantageously be extracted from the package 10 without spilling during use. In an embodiment, for example, the package can contain soluble single unit dose detergent pods.

In general, embodiment of the package 10 disclosed herein can also include indicia or graphics on the exterior sidewalls that display and direct the consumer to conformable or foldable arrangements to the package and how to manipulate the package to manipulate the volume or shape. The graphics can communicate how the package is manipulated based on the magnet placement.

In general, the magnetic regions can be disposed on either side of sidewalls 12 and 14, respectively. As can be understood, in a flexible package 10, the magnetic regions can be disposed on the interior of the flexible package 10, or on the exterior of flexible package 10. In an embodiment, one or more of the magnetic regions can be disposed on the interior of the flexible package 10, and the one or more magnetic regions can be disposed on the outside of the flexible package 10. By placing the magnetic regions on one side or the other of the sidewalls, magnetic attracting force can be affected, either increasing or decreasing the magnetic force as desired. Likewise, if magnetic ink is utilized, the magnetic ink can be applied in a pattern and can include colors, such that the magnetic regions can be visibly incorporated into the flexible package print design.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package, the package comprising:

a first flexible polymeric sidewall having a first perimeter and a second flexible polymeric sidewall having a second perimeter, the first and second flexible polymeric sidewalls being joined by opposing first and second sides and a bottom portion and together defining an access opening to define a maximum volume and depth of the package;

a first magnetic region disposed on the first sidewall;

a second magnetic region disposed on the first sidewall in a spaced relationship relative to the first magnetic region;

a third magnetic region disposed on the second sidewall;

a fourth magnetic region disposed on the second sidewall in a spaced relationship relative to the third magnetic region;

wherein the first and third magnetic regions are magnetically engageable with a magnetic force to urge at least a portion of the first and second sidewalls into contacting relationship, and the second and fourth magnetic regions are magnetically engageable with a magnetic force to urge at least a portion of the first and second sidewalls into contacting relationship;

wherein the package comprises a first state when the first and third magnetic regions and the second and fourth magnetic regions are each partially magnetically engaged in a first position to define a first enclosed volume; and wherein the package comprises a second state wherein the first and third magnetic regions and the second and fourth magnetic regions are each relatively more fully magnetically engaged in a second position to define a second enclosed volume which is less than the first enclosed volume.

2. The package of claim 1, wherein at least one of the first magnetic region, second magnetic region, third magnetic region and fourth magnetic region comprise magnetic ink.

3. The package of claim 2, wherein the magnetic ink is a UV-curable magnetic ink.

4. The package of claim 2, wherein the magnetic ink comprises materials selected from the group consisting of monomers, oligomers, photoinitiators, and rare earth powder.

5. The package of claim 4, wherein the rare earth powder comprises NdFeB.

6. The package of claim 1, wherein at least one of the first magnetic region, second magnetic region, third magnetic region and fourth magnetic region comprise a plurality of parallel spaced apart magnetic bands of alternating north and south poles.

7. The package of claim 1, wherein the first and second flexible polymeric sidewalls comprise a material selected from the group consisting of polyethylene, polyester, polyethylene terephthalate, nylon, polypropylene, polyvinyl chloride, and combinations thereof.

8. A package, the package comprising:

a first flexible polymeric sidewall having a first perimeter and an opposing second flexible polymeric sidewall having a second perimeter, the first and second flexible polymeric sidewalls being joined by a bottom portion opposite an access opening to define a maximum volume and depth of the package;

a first magnetic strip region disposed on the first sidewall;

a second magnetic strip region disposed on the first sidewall in a spaced relationship relative to the first magnetic strip region;

a third magnetic strip region disposed on the second sidewall;

a fourth magnetic strip region disposed on the second sidewall in a spaced relationship relative to the third magnetic strip region;

wherein the first and third magnetic strip regions are magnetically engageable with a magnetic force to urge at least a portion of the first and second sidewalls into contacting relationship, and the second and fourth magnetic strip regions are magnetically engageable with a magnetic force to urge at least a portion of the first and second sidewalls into contacting relationship;

wherein the package comprises a first state when the first and third magnetic strip regions and the second and fourth magnetic strip regions are each partially magnetically engaged in a first position to define a first enclosed volume; and wherein the package comprises a second state wherein the first and third magnetic strip regions and the second and fourth magnetic strip regions are each relatively more fully magnetically engaged in a second position to define a second enclosed volume which is less than the first enclosed volume.

9. The package of claim 8, wherein at least one of the first magnetic strip region, second magnetic strip region, third magnetic strip region and fourth magnetic strip region comprise magnetic ink.

10. The package of claim 9, wherein the magnetic ink is a UV-curable magnetic ink.

11. The package of claim 9, wherein the magnetic ink comprises materials selected from the group consisting of monomers, oligomers, photoinitiators, and rare earth powder.

12. The package of claim 11, wherein the rare earth powder comprises NdFeB.

13. The package of claim 8, wherein at least one of the first magnetic strip region, second magnetic strip region, third magnetic strip region and fourth magnetic strip region comprise a plurality of parallel spaced apart magnetic bands of alternating north and south poles.

14. The package of claim 8, wherein the first and second flexible polymeric sidewalls comprise a material selected from the group consisting of polyethylene, polyester, polyethylene terephthalate, nylon, polypropylene, polyvinyl chloride, and combinations thereof.

15. A package, the package comprising:

a first flexible polymeric major sidewall having a first perimeter and an opposing second flexible polymeric major sidewall having a second perimeter, the first and second flexible polymeric major sidewalls being joined by a bottom portion opposite an access opening;

sidewall fold lines on each of the first and second flexible polymeric major sidewalls;

a first magnetic region disposed at a first corner adjacent the first sidewall and the bottom and having a first corner fold line;

a second magnetic region disposed at a second corner adjacent the first sidewall and the bottom and having a second corner fold line;

a third magnetic region disposed on a first corner adjacent the second sidewall and the bottom and having a third corner fold line;

a fourth magnetic region disposed on a second corner adjacent the second sidewall and the bottom and having a fourth corner fold line;

wherein each of the first, second, third and fourth magnetic regions comprise attracting north and south magnetic poles separated by their respective corner fold lines; and wherein the package comprises a first state when the sidewall fold lines and first, second, third, and fourth corner fold lines are not folded, and a second state wherein sidewall fold lines are folded to define two opposing minor sidewalls joined to the first and second major sidewalls, and wherein the first, second, third, and fourth corner fold lines are folded such that the north and south magnetic poles of each of the first, second, third, and fourth magnetic regions are in separable magnetic contact.

16. The package of claim 15, wherein at least one of the first magnetic region, second magnetic region, third magnetic region and fourth magnetic region comprise UV-curable magnetic ink.

17. The package of claim 16, wherein the magnetic ink comprises materials selected from the group consisting of monomers, oligomers, photoinitiators, and rare earth powder.

18. The package of claim 17, wherein the rare earth powder comprises NdFeB.

19. The package of claim 15, wherein at least one of the first magnetic region, second magnetic region, third magnetic region and fourth magnetic region comprise a plurality of parallel spaced apart magnetic bands of alternating north and south poles.

20. The package of claim 15, wherein the first and second flexible polymeric sidewalls comprise a material selected from the group consisting of polyethylene, polyester, polyethylene terephthalate, nylon, polypropylene, polyvinyl chloride, and combinations thereof.

* * * * *